US006243903B1

(12) United States Patent
Taniguchi

(10) Patent No.: US 6,243,903 B1
(45) Date of Patent: Jun. 12, 2001

(54) PRINT MATERIAL REMOVING APPARATUS

(75) Inventor: Kazuko Taniguchi, Osaka (JP)

(73) Assignee: Minolta Co., Ltd., Osaka (JP)

( * ) Notice: Subject to any disclaimer, the term of this patent is extended or adjusted under 35 U.S.C. 154(b) by 0 days.

(21) Appl. No.: 09/390,686

(22) Filed: Sep. 7, 1999

(30) Foreign Application Priority Data

Sep. 8, 1998 (JP) ..... 10-253724

(51) Int. Cl.[7] ..... B08B 1/02; B08B 3/14
(52) U.S. Cl. ..... 15/77; 15/88.3; 134/122 R
(58) Field of Search ..... 15/3, 77, 88.2, 15/88.3, 102; 134/64 R, 122 R

(56) References Cited

U.S. PATENT DOCUMENTS 5,528,788 * 6/1996 Yamamoto et al. ..... 15/77
5,621,939 * 4/1997 Yoshida et al. ..... 15/77
5,694,657 * 12/1997 Yoshida et al. ..... 15/88.3

FOREIGN PATENT DOCUMENTS 2-111987 4/1990 (JP) .
07140554 2/1995 (JP) .

* cited by examiner

*Primary Examiner*—Mark Spisich
(74) *Attorney, Agent, or Firm*—McDermott, Will & Emery

(57) ABSTRACT

A print material removing apparatus for removing a print material from a printed record medium, the apparatus comprising: a treating bath 3 filled with a treating liquid 2, the treating bath 3 removing the print material from the printed record medium 1 immersed into the treating liquid 2; a feed path 22 for feeding the treating liquid 2 to the treating bath 3; a discharge path 30 for discharging the treating liquid 2 from the treating bath 3; a feed cartridge 31 to be detachably connected to the feed path 22; and a discharge cartridge 32 to be detachably connected to the discharge path 30. Thus, the apparatus enhances the handling-ability of the sheet 1 and eliminates the user's uncomfortable feeling at the jam treatment.

14 Claims, 4 Drawing Sheets

PRINT MATERIAL REMOVING APPARATUS

This application is based on application No. H10-253724 filed in Japan on Sep. 8, 1998, the content of which is hereby incorporated by reference.

BACKGROUND OF THE INVENTION

The present invention relates to a print material removing apparatus, particularly to a print material removing apparatus utilizing a liquid.

Conventionally, from the point of view of sheet recycling, there have been proposed a variety of apparatuses for removing the print material on a sheet as a recording member, on which characters or images are recorded by an electrophotographic apparatus, by impregnating the sheet with a liquid to reuse the sheet. For example, Japanese Patent Laid-Open Publication No. 2-111987 discloses an apparatus in which an OHP sheet printed by an electrophotographic copying machine is immersed into a treating bath filled with organic solvent to swell the toner as a print material which is then removed from the OHP sheet by a brush roller. Japanese Patent Laid-Open Publication No. 7-140554 discloses an apparatus in which a sheet having a water-swelling surface layer is immersed into a treating bath filled with water to swell the surface layer and then the print material is removed by a brush roller.

In such print material removing apparatus utilizing a liquid, the liquid is brought out by adhering to the sheet and vaporizes from the treating bath. Therefore, it is necessary to periodically replenish the treating bath with the liquid. Since the liquid becomes foul or deteriorated, it is also necessary to timely drain the liquid from the treating bath. Thus, the apparatus has been desired to easily conduct replenishment and drainage of the liquid. Furthermore, in such apparatus, when a sheet jam is caused in the liquid, not only handling for taking the sheet out of the liquid is difficult, but also user's hands are fouled with the liquid, making the user uncomfortable. Thus, there has been a disadvantage that jam treatment or maintenance such as cleaning of the treating bath can not be easily conducted.

Japanese Patent Laid-Open Publication No. 2-111987 discloses an apparatus provided with a trap channel on the bottom of a treating bath filled with organic solvent and with a waste chamber via a gate valve under the trap channel. The apparatus is possible to drain the sediment in the trap channel of the treating bath into the waste chamber by opening the gate valve. However, the waste chamber of the apparatus described in the above publication is provided only for draining the sediment and never used at jam treatment. The waste chamber has not a construction that the liquid drained in the waste chamber can be transferred to the treating bath. Therefore, even if the liquid in the treating bath is discharged into the waste chamber via the gate valve at the occurrence of jam, the liquid can not be reused. This means that the apparatus can not be immediately restored to an operable condition.

SUMMARY OF THE INVENTION

Accordingly, it is an object of the present invention to provide a novel useful print material removing apparatus having a superior maintenance-ability.

It is an another object of the present invention to provide a print material removing apparatus having a simple construction capable of easily conducting a maintenance such as replenishment and exchange of liquid, jam treatment, cleaning or the like and also capable of being shortly recovered from such maintenance conditions.

In order to solve the aforementioned problems, the present invention provides a print material removing apparatus for removing a print material from a printed record medium, the apparatus comprising:

- a treating bath filled with a treating liquid, the treating bath removing the print material from the printed record medium immersed into the treating liquid;
- a feed path for feeding the treating liquid to the treating bath;
- a discharge path for discharging the treating liquid from the treating bath;
- a feed cartridge to be detachably connected to the feed path; and
- a discharge cartridge to be detachably connected to the discharge path.

In the print material removing apparatus according to the present invention having above construction, the feed cartridge and the discharge cartridge are to be detachably connected to the feed path and discharge path respectively. Thus, the replenishment of the treating liquid to the treating bath can be easily conducted only by filling the feed cartridge with the treating liquid outside the apparatus and then connecting the feed cartridge to the feed path. Further, the treating liquid in the treating bath can be discharged into the discharge cartridge and then the discharge cartridge is easily disconnected from the discharge path to dispose of the treating liquid. For example, in the case that jam of the recording medium occurs, user can remove the recording medium without touching the treating liquid in the treating bath by discharging the treating liquid in the treating bath into the discharge cartridge via the discharge path. After completion of jam treatment, the treatment liquid can be fed into the treating bath via the feed path, enabling to immediately operate the print material removing apparatus again.

Thus, with the simple construction, maintenance such as replenishment and exchange of the treating liquid, jam treatment and cleaning can be easily conducted. Further, recovery from these treatment can be accomplished at a short time, producing superior maintenance ability.

Preferably, the feed cartridge and the discharge cartridge may be interchangeable with each other. Thus, the discharge cartridge into which the treating liquid in the treating bath is discharged can be used as a feed cartridge as it is, enhancing user-friendliness.

BRIEF DESCRIPTION OF THE DRAWINGS

Further objects and advantages of the present invention will become clear from the following description taken in conjunction with the preferred embodiments thereof with reference to the accompanying drawings, in which.

DETAILED DESCRIPTION OF THE PREFERRED EMBODIMENTS

Figure 1:
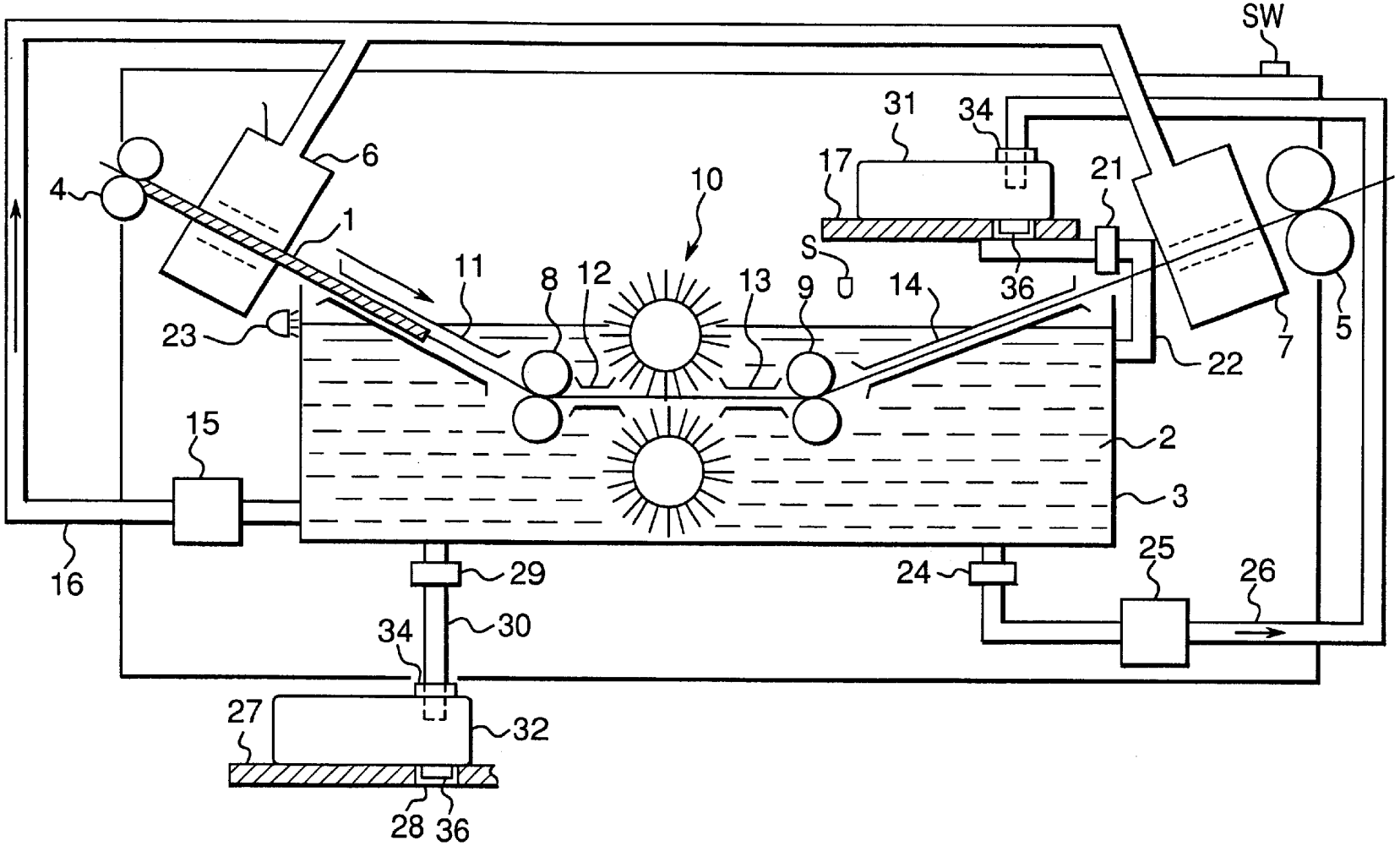
FIG. 1 is a schematic sectional view of a print material removing apparatus according to the present invention.

FIG. 1 shows a print material removing apparatus according to an embodiment of the present invention. The apparatus comprises a treating bath 3 opened upwardly. The treating bath 3 is filled with a liquid 2 for removing the print material on a sheet 1 as a recording member. On the left side of the treating bath 3 in FIG. 1 is provided a sheet feed roller 4, while on the right side is provided a drying roller 5. At the downstream side of the sheet feed roller 4 is disposed a first shower unit 6 for showering the both surfaces of the sheet 1 with the liquid 2 to removing the print material on the sheet 1. At the upstream side of the drying roller 5 is disposed a second shower unit 7 for washing down the print material remaining on the sheet 1.

As the liquid for removing the print material, in the case of removing the print material by dissolving or swelling the print material, organic solvent having a property of dissolving or swelling the print material or such organic solvent with additive such as surface-active agent can be used. In the case of removing the print material by swelling the surface of the sheet, liquid such as water or aqueous solvent having a property of swelling the surface of the sheet, or such liquid with additive such as surface-active agent can be used.

Inside the treating bath 3 are disposed first and second sheet conveying rollers 8 and 9 between which a scraping roller 10 is disposed. Between the sheet feed roller 4 and the first sheet conveying roller 8, between the first sheet conveying roller 8 and the scraping roller 10, between the scraping roller 10 and the second sheet conveying roller 9, and between the second sheet conveying roller 9 and the drying roller 5, there are disposed sheet guides 11, 12, 13 and 14 for guiding the both side of the sheet 1.

Outside the treating bath 3 is arranged a liquid circulation line 16 which starts from the bottom of the treating bath 3 via a pump 15, leads to the first shower unit 6 and the second shower unit 7, and returns to the treating bath 3 from the first and second shower units 6, 7.

Figure 2:
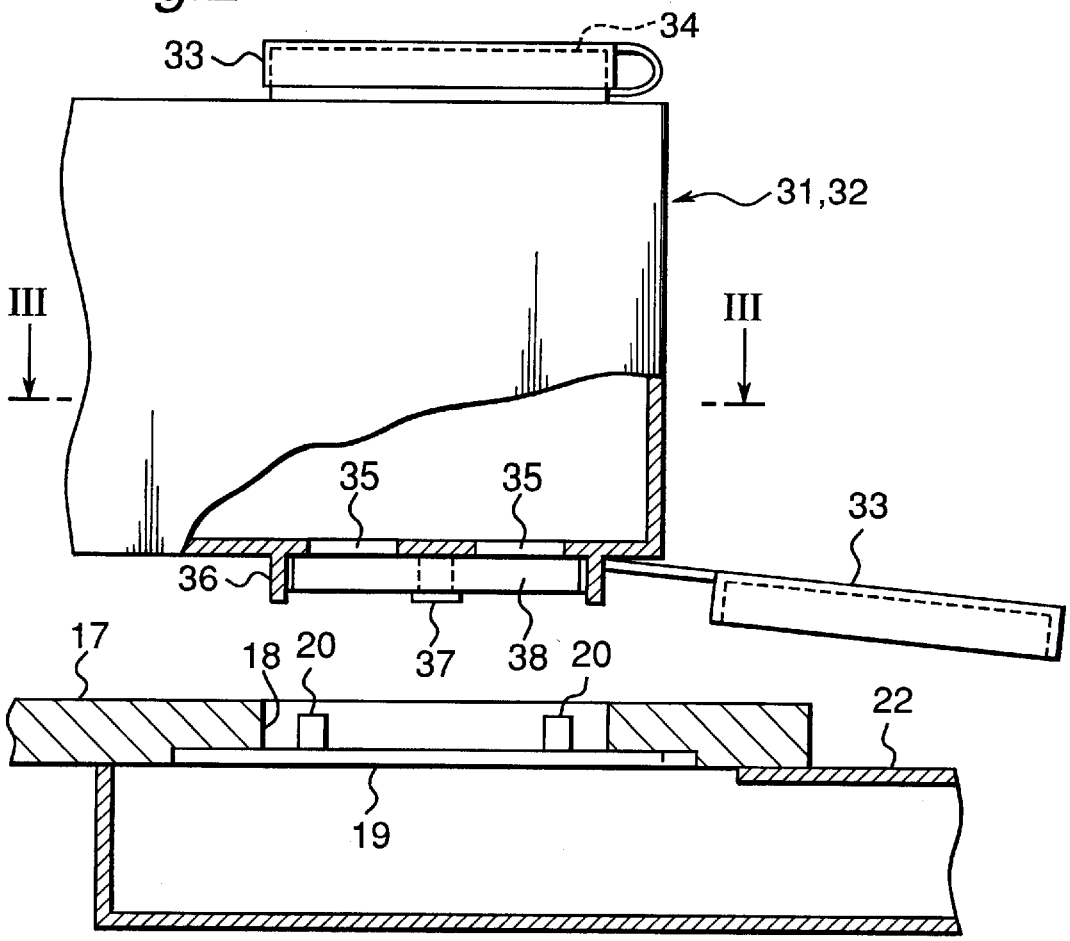
FIG. 2 is a partial sectional view of a cartridge and a cartridge guide of FIG. 1.

Above the treating bath 3 is disposed a feed cartridge guide 17 having a configuration of rectangular plate for guiding and mounting a feed cartridge 31 which will be described hereinafter. As shown in FIG. 2, the feed cartridge guide 17 is formed with a mounting hole 18. On the under surface of the feed cartridge guide 17, a cross bar 19 is fixed so that the cross bar 19 crosses the mounting hole 18. The cross bar 19 is provided with two projections 20 projecting upwardly into the mounting hole 18. From the mounting hole 18 of the feed cartridge guide 17 is arranged a liquid feed line 22 to the top of the treating bath 3 via a gate valve 21. The gate valve 21 is arranged to close when a liquid level sensor 23 detects a predetermined liquid level. The gate valve 21 has a lock mechanism for holding the valve in a closing state if necessary, for example, in the case of jam treatment. There is arranged a circulation hose 26 which starts from the bottom of the treating bath 3 via a cock 24 and a pump 25 with built-in filter, and leads to a feed port 34 of a feed cartridge 31 which will be described hereinafter. The cock may be opened at predetermined time interval when no maintenance work such as jam treatment is conducted.

Under the treating bath 3 is disposed a discharge cartridge guide 27 having a configuration of rectangular plate for guiding and mounting a discharge cartridge 32 which will be described hereinafter. The discharge cartridge guide 27 is formed with a mounting hole 28 in the same manner as the feed cartridge guide 17. In the discharge cartridge guide 27, no provisions such as the cross bar 19, its projections 20 and the liquid feed line 22 in the aforementioned mounting hole 18 of the feed cartridge quid 17 are provided. There is arranged a discharge circulation hose 30 which starts from the bottom of the treating bath 3 via a cock 29, and leads to a discharge port 34 of a discharge cartridge 32.

The feed cartridge 31 and the discharge cartridge 32 to be mounted on the feed cartridge guide 17 and the discharge cartridge guide 27 respectively will be explained below on the assumption that both are same.

Figure 3:
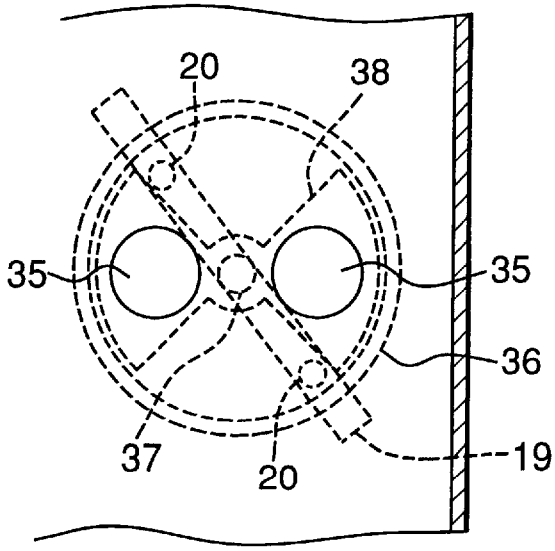
FIG. 3 is a sectional view taken along line III—III in FIG. 2.

The two cartridges 31, 32 are rectangular vessels respectively. On the top surface of each cartridges 31, 32 is formed with a circular feed port 34 closable with a cap 33. On the bottom surface of each cartridges 31, 32 is formed with a discharge port 36 comprising two openings 35, 35. The discharge port 36 is also closable with a cap 33. Inside the discharge port 36 is rotatably attached a bow-like slide valve 38 around an axis 37 as shown in FIG. 3 so that the two openings 35 are opened and closed by the rotation of the slide valve 38.

Operation of the print material removing apparatus having above construction will be described hereinafter.

The printed sheet 1 is fed in a direction of arrow in FIG. 1 by the sheet feed roller 4 and showered with the liquid by the first shower unit 6. Then the sheet 1 passes through the sheet guide 11 and is immersed in the liquid 2 in the treating bath 3. Thus, in the case that the liquid for dissolving or swelling the print material is used, the liquid penetrates into the print material on the sheet to dissolve or swell the print material. In the case that the sheet having a water-swelling surface layer is used, an aqueous solvent penetrates into the surface layer of the sheet to swell the sheet surface layer. As a result, adhesiveness between the print material and the sheet surface are weakened, leading to a condition that the print material is easily removed from the sheet surface. It is also possible to extend the penetration time of the sheet 1 into the liquid 2 in the treating bath 3 by temporarily stopping conveying the sheet 1 in order to enhance the penetration of the liquid.

Consequently, the sheet 1 is conveyed to the scraping roller 10 through the first sheet conveying roller 8 and the sheet guide 12, where the print material on the sheet 1 is scraped. Then, the sheet 1 emerges from the liquid 2 through the sheet guide 13, the second sheet conveying roller 9 and the sheet guide 14. After the print material remaining on the sheet 1 is washed down by the second shower unit 7, the sheet 1 is dried by the drying roller 5 and discharged outside of the apparatus. As a result, the sheet 1 becomes reusable.

When occurrence of sheet jam is detected by a jam sensor S during the removing operation of the print material, the gate valve 21 is locked to keep closed. Then, the cock 29 at the bottom of the treating bath 3 is opened to transfer the liquid 2 in the treating bath 3 to the discharge cartridge 32 via the discharge hose 30. In this case, prior to opening the cock 29, the discharge cartridge 32 has been mounted beforehand on the discharge cartridge guide 27 by engaging the discharge port 36 closed by the cap 33 with the mounting hole 28 of the discharge cartridge guide 27, while the discharge hose 30 has been inserted into the feed port 34 opened by taking off the cap 33.

The liquid 2 in the treating bath 3 is not necessarily transferred thoroughly but may be transferred to an extent that the liquid level becomes slightly lower than the conveying path of the sheet 1 so that the jam treatment can be easily conducted. If the liquid 2 is deteriorated, the discharge cartridge 32 would be recovered to dispose of the liquid 2 as a waste liquid. If the liquid 2 is reusable, the discharge cartridge 32 would be interchanged with the feed cartridge 31 mounted on the feed cartridge guide 17.

Figure 4:
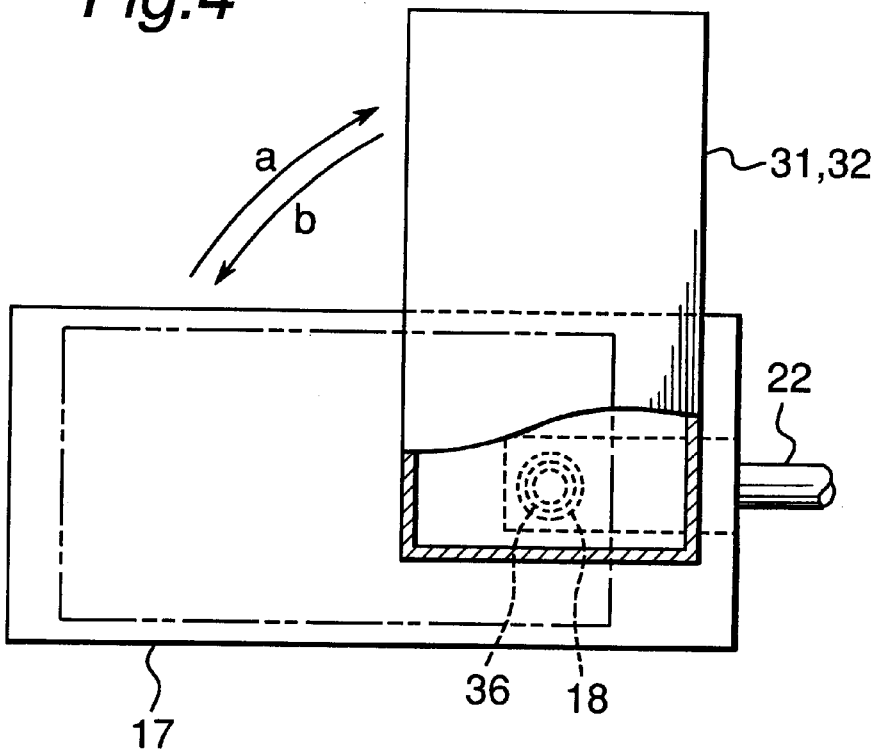
FIG. 4 is a plane view showing a removing and mounting operation of the cartridge with respect to the cartridge guide.
Figure 5:
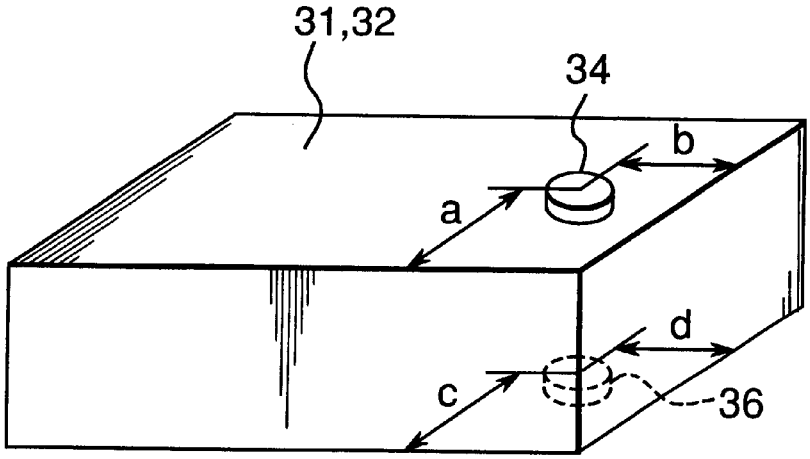
FIG. 5 is a perspective view showing a positional relation of a feed port and a discharge port of the cartridge.

In order to dismount the feed cartridge 31 from the feed cartridge guide 17, as shown in FIG. 4, the feed cartridge 31 is slid in a direction of arrow "a" from a state shown in two-dots chain line and rotated by a predetermined angle around the discharge port 36. Then, the slide valve 38 is pushed by the projections 20 of the mounting hole 18 to relatively rotate, whereby the discharge port 36 is closed. Consequently, upon lifting up the feed cartridge 31, the feed cartridge 31 can be dismounted from the feed cartridge guide 17 without spilling the liquid.

Subsequently, in order to mount the discharge cartridge 32 on the feed cartridge guide 17, as shown in FIG. 4, the discharge cartridge 32 is put on the feed cartridge guide 17 in a rotating state with respect to the feed cartridge guide 17 in a predetermined angle so that the discharge port 36 of the discharge cartridge 32 can be fit in the mounting hole 18 of the feed cartridge guide 17. Then, the discharge cartridge 31 is slid in a direction of arrow "b" from a state shown in solid line and rotated by a predetermined angle around the discharge port 36. Then, the slide valve 38 is pushed by the projections 20 of the mounting hole 18 to relatively rotate, whereby the discharge port 36 is opened. Consequently, the feed cartridge 31 can be mounted on the feed cartridge guide 17 without spilling the liquid.

After completion of the jam treatment, the switch SW is ON and the gate valve 21 of the feed line 22 is unlocked to open. As a result, the liquid in the discharge cartridge 32 mounted on the discharge cartridge guide 17 flows out of the discharge hole 35 and returns to the treating bath 3 through the feed line 22. When the liquid 2 in the treating bath 3 becomes to the predetermined liquid level, the liquid level sensor 23 detects this, allowing the gate valve 21 to be closed. Thus, the print material removing apparatus can be operated again.

In the case that a serviceman cleans the treating bath 3 in his regular service, the liquid 2 in the treating bath 3 is transferred thoroughly to the discharge cartridge 32. Thus, he can take the treating bath 3 with no liquid out of the apparatus to clean it. After completion of cleaning, the liquid is fed from the feed cartridge 31 to the treating bath 3, or the liquid is returned to the treating bath 3 by mounting the discharge cartridge 32 instead of the feed cartridge, whereby the apparatus can be immediately operated again. If the liquid is deteriorated, the liquid is discharged into the discharge cartridge 32 and then fresh liquid is fed from a new feed cartridge 31.

In FIG. 1, the circulation hose 26 is provided so as to constantly keep the liquid clean by circulating the liquid. The print material such as toner and other impure ingredient are removed by the filter build in the pump 25 so as not to enter into the circulation hose 26. In the case that the liquid is consumed little by little due to takeout by adhering to the sheet or vaporization and becomes short, the liquid can be replenished by dismounting the feed cartridge 31 to fill it with fresh liquid and then mounting it again, or by mounting an another feed cartridge 31 filled with fresh liquid. In order to simplify the construction of the apparatus, it is possible not to provide the circulation hose 26. In this case, at the time when the feed cartridge 31 becomes empty, the feed cartridge may be exchanged with a new feed cartridge 31 filled with fresh liquid, or the feed cartridge 31 may be dismounted to fill it with fresh liquid and then mounted again.

In the aforementioned embodiment, two cartridges 31, 32 have the same configuration. However, those may have different configuration from each other if the position of the feed port 34 and the discharge port 36, i.e., the dimensions "a", "b", "c" and "d" from the side surfaces are same.

Figure 6:
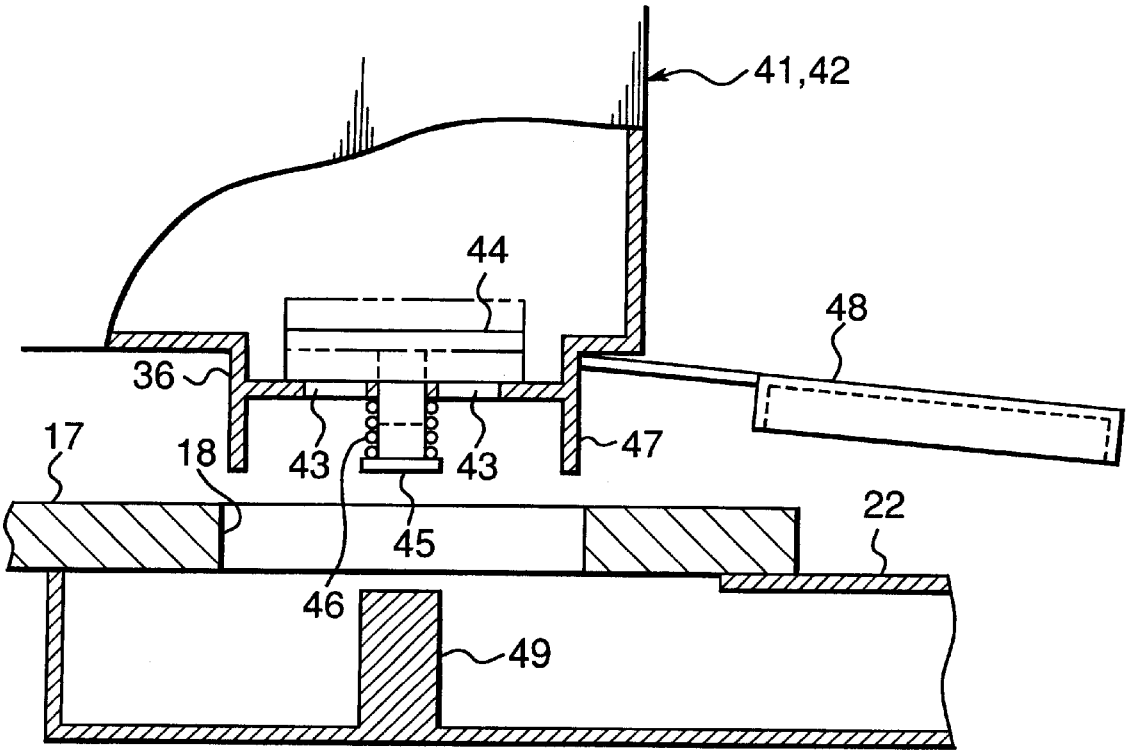
FIG. 6 is a partial sectional view showing an another embodiment of a cartridge and a cartridge guide.

FIG. 6 shows an another embodiment of the present invention, in particular an another embodiment of valve construction of a discharge port 47 of a feed cartridge 41 and a discharge cartridge 42.

In this embodiment, a valve 44 is provided inside the discharge port 47 so that a valve shaft 45 extends to the outside from the inside of the discharge port 47. The valve 45 is biased downwardly by means of a spring 46 so that the valve 45 can close openings 43 of the discharge port 47 formed on the bottom of the cartridges 41, 42. The discharge port 47 is closable with a cap 48. On the other hand, on the inner surface of the liquid feed line 22 of the feed cartridge guide 17 is formed a protrusion 49 facing to the valve shaft 45 of the valve 44 via the mounting hole 18. Thus, when the cartridges 41, 42 are mounted on the discharge cartridge guide 17, the valve shaft 45 of the valve 44 is push up by the projection 49 as shown in two-dots chain line in FIG. 6, causing the openings 43 to be opened. A bias means for biasing the feed cartridge 41 downwardly may be provided above the feed cartridge 41.

In this embodiment, comparing to the embodiment of FIG. 2, the cartridges 41, 42 can be easily handled because the cartridges 41, 42 are mounted by just putting them on the cartridge guide 17.

Although the present invention has been fully described by way of the examples with reference to the accompanying drawings, it is to be noted here that various changes and modifications will be apparent to those skilled in the art. Therefore, unless such changes and modifications otherwise depart from the spirit and scope of the present invention, they should be construed as being included therein.

What is claimed is:

1. A print material removing apparatus for removing a print material from a printed record medium, the apparatus comprising:

a treating bath filled with a treating liquid, the treating bath removing the print material from the printed record medium immersed into the treating liquid;

a feed path for feeding the treating liquid to the treating bath;

a discharge path for discharging the treating liquid from the treating bath;

a feed cartridge to be detachably connected to the feed path; and a discharge cartridge to be detachably connected to the discharge path.

2. The apparatus as in claim 1, further comprising;

a removing device for removing the print material, the removing device being provided in the treating bath.

3. The apparatus as in claim 2, wherein the removing device removes the print material by utilizing a physical force.

4. The apparatus as in claim 1, wherein the feed cartridge and the discharge cartridge are interchangeable with each other.

5. The apparatus as in claim 1, further comprising;

a jam detecting device for detecting whether or not the apparatus causes jam of the printed recording medium; and a control device for closing the feed path to prohibit the treating liquid from feeding the treating liquid to the treating bath when the jam of the printed recording medium is detected, and for opening the discharge path to transfer the treating liquid into the discharge cartridge from the treating bath when the jam of the printed recording medium is detected.

6. The apparatus as in claim 5, further comprising;

a refeeding device for opening the closed feed path to refeed the liquid into the treating bath.

7. The apparatus as in claim 1, wherein the feed path constitutes a circulation path for receiving the treating liquid from the treating bath and feeding the treating liquid to the treating bath.

8. The apparatus as in claim 7, wherein the circulation path includes a filter.

9. A print material removing apparatus for removing a print material from a printed record medium, the apparatus comprising:

a treating bath filled with a treating liquid, the treating bath removing the print material from the printed record medium immersed into the treating liquid;

a feed path for feeding the treating liquid to the treating bath, the feed path including a first gate member;

a discharge path for discharging the treating liquid from the treating bath, the discharge path including a second gate member;

a feed cartridge to be detachably connected to the feed path; and a discharge cartridge to be detachably connected to the discharge path.

10. The apparatus as in claim 9, further comprising;

a control device for closing the first gate member to prohibit the treating liquid from feeding the treating liquid to the treating bath at a predetermined condition, and for opening the second gate member to transfer the treating liquid into the discharge cartridge from the treating bath at the predetermined condition.

11. The apparatus as in claim 10, further comprising;

a jam detecting device for detecting whether or not the apparatus causes jam of the printed recording medium; and wherein the predetermined condition is a condition that the jam detecting device detects the jam of the printed recording medium.

12. The apparatus as in claim 9, further comprising;

a removing device for removing the print material, the removing device being provided in the treating bath.

13. The apparatus as in claim 12, wherein the removing device removes the print material by utilizing a physical force.

14. The apparatus as in claim 9, wherein the feed cartridge and the discharge cartridge are interchangeable with each other.

* * * * *